US005468036A

United States Patent [19]

Brown

[11] Patent Number: 5,468,036

[45] Date of Patent: Nov. 21, 1995

[54] SKI AND SKI POLE TRANSPORT STRAP SYSTEM

[76] Inventor: Ronny W. Brown, 109 Spring River Rd., Sherwood, Ark. 72116

[21] Appl. No.: 195,312

[22] Filed: Feb. 14, 1994

[51] Int. Cl.[6] ..... A63C 11/02

[52] U.S. Cl. ..... 294/147; 224/917; 280/814

[58] Field of Search ..... 294/147, 149, 294/150, 157; 24/298, 306, 442; 224/191, 202, 257, 901, 917; 280/814

[56] References Cited

U.S. PATENT DOCUMENTS

| | | | |
|---|---|---|---|
| 3,279,008 | 10/1966 | Wallach | 280/814 X |
| 3,731,348 | 5/1973 | Luehne | 280/814 |
| 3,947,927 | 4/1976 | Rosenthal | 294/147 X |
| 3,994,048 | 11/1976 | Rosenthal | 294/147 X |
| 4,120,437 | 10/1978 | Hara | 294/147 X |
| 4,470,528 | 9/1984 | Dyess | 294/147 X |
| 4,531,661 | 7/1985 | Santy | 294/147 X |
| 4,553,779 | 11/1985 | Shortridge | 294/147 |
| 5,056,820 | 10/1991 | Des Prez | 294/147 X |
| 5,197,760 | 3/1993 | Schollenberger | 280/814 |

*Primary Examiner*—Johnny D. Cherry
*Attorney, Agent, or Firm*—Trent Keisling; Stephen D. Carver

[57] ABSTRACT

A strap system for temporarily binding skis and poles together for easy carrying and stowage. The system comprises a pair of hook and loop pile fastener material straps for securing the skis face to face. Each strap comprises an elongated body having an outer side provided with fastener material and inner and remote ends. A gripping surface and fastener material backing are affixed to an inner side of the body. The gripping surface frictionally contacts a pair of skis bound by the straps, preventing slippage of the installed strap. The backing releasably engages the body's fastener material when the strap is installed. A ski pole band for separately, releasably binding ski poles to previously bound skis extends from a central portion of the body. The band is a length of fastener material adapted to selectively mate with the body outer side fastener material. When deployed, the band provides a smooth, protective outer side for normally guarding the installed strap. The strap can also be marked with advertising indicia. Poles mounted by the system are generally arranged parallel with the skis and with the grips and tips of the poles disposed in contact. The remote end of the body and band terminate in reinforced gripping tabs, disposed adjacent one another when the strap is installed. A reinforcing brake disposed at the central portion of the body secures the band to the body and acts as a stop to terminate engagement of fastener material during strap installation.

16 Claims, 7 Drawing Sheets

SKI AND SKI POLE TRANSPORT STRAP SYSTEM

BACKGROUND OF THE INVENTION

1. Field of the Invention

The present invention relates generally to ski and ski pole transport devices. More particularly, the present invention relates to ski and ski pole strap devices which aid in handling and transporting ski equipment.

2. Description of the Prior Art

Due to their elongated shape, skis and ski poles are difficult and cumbersome to handle. Many prior art ski and ski pole carrying devices have been proposed. Generally, these devices combine the skis and poles in a single unit with the skis and poles generally parallel to one another for convenient carrying.

Many of these devices employ brackets or the like to rigidly mount the skis relative to the poles. Uyeda, U.S. Pat. No. 4,588,115, is one such device. Another device of this type is Hickey, U.S. Pat. No. 4,190,182. Allen, U.S. Pat. No. 3,985,275, is also a similar device. Wichersham, U.S. Pat. No. 4,871,102, discloses a shoulder mounted device to facilitate the carrying of skis which can be strapped to an ankle once its use for carrying the skis has ended.

Hogensen, U.S. Pat. No. 3,920,166, discloses a ski carrier strap which is convertible to be used as a belt once it is no longer needed to carry the skis.

It has long been recognized in the art that fabric straps with hook and loop pile fasteners such as Velcro® are versatile and convenient for bundling and transporting skis. Coats, U.S. Pat. No. 5,160,074, discloses a ski sling which has hook and loop fastener material disposed on the end of the sling. Sage, U.S. Pat. No. 4,833,901, discloses a wrap and lock ski holding assembly which also employs a chain in association with the straps employing hook and loop fastener material. Shortridge, U.S. Pat. No. 4,553,779, discloses a relatively wide band of fabric with carrying loops. The fabric is wrapped around the skis and ski poles and held in place with hook and loop fastener material or the like. Ball U.S. Pat. No. 4,463,885, discloses a single loop ski carrier strap. Two hook and loop tabs are used to disposed the strap in a "Figure 8" arrangement around the skis and ski poles. Knauf, U.S. Pat. No. 4,114,838, discloses an elongated ski carrier which has two perpendicular tabs of hook and loop fastener material disposed on its ends. Mazzoni, U.S. Pat. No. 3,960,302, is a ski carrying strap similar to Knauf and Ball.

Most pertinent to the present invention are Rosenthal, U.S. Pat. No. 3,947,927 and Dyess, U.S. Pat. No. 4,470,528. Rosenthal discloses a strap employing two "D-rings" to form a lower loop and an upper loop which are constructed of hook and loop fastener material. The lower loop encompasses a pair of skis while the upper loop surrounds a pair of ski poles. Dyess discloses a strap which also employs a "D-ring". A section of padding material disposed between the skis is attached to the "D-ring". A length of hook and loop fastener material extends from the "D-ring" to encircle and hold a pair of skis together.

Snow skiers face several specific circumstances where a well-designed ski transport strap could prevent problems. For example, it is generally required that ski poles be unbundled from their skis in order to transport the skis on the exterior ski buses. The ski poles must be carried within by the owner for safety reasons. A storage rack is often provided at the entrance to establishments in skiing areas. Generally, these racks consist only of a set of pegs extending from a wall. To effectively use such a rack the skis need to be tightly bound together. Similarly, skis are often stored during long periods of non-use. Therefore, if they are conveniently bundled they will take up less space. When stored they will generally be in a location where other items are stored. So, it is important that a bundling strap employing hook and loop material not have a tendency to attach itself to other fabric.

The prior art fails to disclose a ski transport strap that is sufficiently convenient for use. It is desirous to provide a ski carrying strap that would be convenient to deploy and would be easy to remove and store after use. Furthermore, it is desirous to provide a ski strap that employs a convenient material such as Velcro® or Mastex® while also protecting this material from inadvertent engagement with other fabric during transport or storage of the skis.

In particular, it is desirous to provide a ski strap that can be wrapped around a set of skis a single time without the need for feeding it through relatively narrow loops or rings. Further, the strap should provide a gripping or frictional surface which will non-destructively grip the skis in a non-slip fashion. This surface serves to avoid slippage of the straps during carrying, regardless of the angle of orientation of the skis. The strap must be convenient to handle by an individual wearing gloves.

Furthermore, it is desirous that this ski strap be convertible in such a way that the ski poles may be first removed from the skis without releasing the skis from one another. Once the straps are removed from the skis, they should be capable of being easily stowed. The straps may be wrapped and secured around an individual's leg or arm. Alternatively, they may be conveniently rolled up for stowage in a pocket or pack. The exterior of the strap exposed during use or when being worn by an individual should provide a surface for indicia. The indicia can include identification or advertising by a manufacturer or business.

SUMMARY OF THE INVENTION

My straps provide a convenient to use ski and ski pole transport system. They are convenient to deploy, utilizing hook and loop fastening material. They provide easy to grip pull tabs capable of being manipulated by an individual wearing gloves. The tabs also facilitate removal. When removed from the skis, my straps can be easily rolled and stowed or they can be wrapped and secured around an individual's leg or arm. My straps have a rubberized inner face intended to frictional engage the skis gripping them. Thus, slippage of the straps is avoided, regardless of the angle of the skis.

My strap also incorporates a ski pole band which permits attachment and removal of the ski poles from the bundled skis. The exterior surface of the ski pole band is relatively smooth. Thusly, the band prevents inadvertent engagement between the Velcro® and other fabric. This smooth exterior also provides a surface particularly well suited for indicia. Advertising or identification indicia is prominently displayed during use bundling skis or when worn around a skier's arm or leg.

My ski and pole transport strap system comprises straps, used in pairs to fasten a pair of snow skis together and then to fasten a set of ski poles to the pair of skis. My system facilitates transporting or carrying skis and poles together as a unit. However, the poles can be easily detached if necessary. The straps are primarily constructed from hook and loop pile fastener material of the type commonly known as Velcro® or Mastex®.

The straps comprise a central elongated body or ply made of one type of fastener material and an opposite, inner face. The inner face is comprised of a length of gripping surface material and a backing of the second type of fastener material. In the preferred embodiment, the body is constructed from a length of hook fastener material, and the backing comprises loop fastener material.

The gripping surface is provided by a section of rubberized material. It extends from an inner end of the body approximately one third of the way along the length of the strap. The gripping surface frictionally contacts the top and edges of the skis to help maintain the strap in place regardless of the angle at which the skis are carried.

The fastener material backing extends from the gripping surface to the remote end of the strap. The loop fastener material backing contacts the hook fastener material of the body when the strap is wrapped around a pair of skis.

A ski pole band, adapted to secure a pair of ski poles to the joined skis, extends from a central portion of the strap body. This band is made of fastener material adapted to mate with the fastener material comprising the body. Therefore, in the preferred embodiment the band is comprised of loop fastener material. The outwardly facing, smooth side of the band serves as a guard, to prevent inadvertent engagement of the hook or loop material of the strap with other fabric, such as luggage, clothing or other ski straps.

A reinforcing brake secures the band to the strap body. The reinforcing brake is comprised of a rectangular segment of a durable material such as leather or vinyl. Preferably, the entire strap is sewn together. The stitching through the brake and the band securing them to the body also penetrates the backing material. Alternatively, the brake may extend the full length of the band as reinforcement and to provide a surface for indicia.

Gripping tabs are stitched to, the free end of the band and the aforementioned remote end of the body. The tabs may be gripped by a user during installation and removal.

To bundle a pair of skis with my straps, the snow skis are positioned with their faces together. The ski tips may be facing in the same direction or opposite directions.

The first strap is deployed around the skis within about one-third of the distance from the end of the skis. The gripping surface is placed against the surface of one ski. The body tab is gripped and the strap is pulled tightly around the skis engaging the loop fastener backing with the hook fastener body. Once the strap contacts the reinforcing brake, installation stops. A second strap is similarly wrapped around the skis near the opposite end.

With the skis so bound, poles may then be secured. The user grips the band tab with one hand and the body tab with the other. The body tab is held in place as the band tab is pulled free from the strap. The other band is similarly freed. The ski poles are laid along the skis with the tip of one pole adjacent the grip of the other. The bands are then wrapped over the ski poles and pulled tight. The band loop fastener material engages the body's hook fastener material. The resultant offset between the poles and the skis facilitate use of the poles as a handle to carry the ski and ski pole assembly.

Removal is the reverse of installation. The tabs are grasped and pulled apart, freeing the poles. The skis are released by grasping the body tab and pulling the backing clear of the body. The straps may be stowed by wrapping them around an arm or leg or rolled up and packed away.

Therefore, a primary object of my ski and ski pole transport strap system is to provide a convenient system for bundling skis and ski poles together.

An object of the present invention is to provide a ski transport strap which frictionally contacts the skis without damaging them to prevent slippage of the strap regardless of the angle the skis are carried.

Another object is to provide a ski transport strap which will separately removably mount ski poles parallel to a pair of bound skis.

A further object is to provide a ski transport strap which can be conveniently carried by a skier following use.

An object is to provide a ski transport strap which can be rolled and stowed in a pocket.

An object is to provide a ski transport strap which can be wrapped and secured around a skier's leg or arm after removal from the skis.

An object of the present ski transport strap is to hold a pair of skis together while presenting a smooth outer surface to guard against inadvertent entanglement between the strap and fabric articles.

A further object of the present ski transport strap is to provide a smooth exterior surface particularly well suited for the application of fashionable colors, designs, indicia, advertising or identification.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

Figure 2:
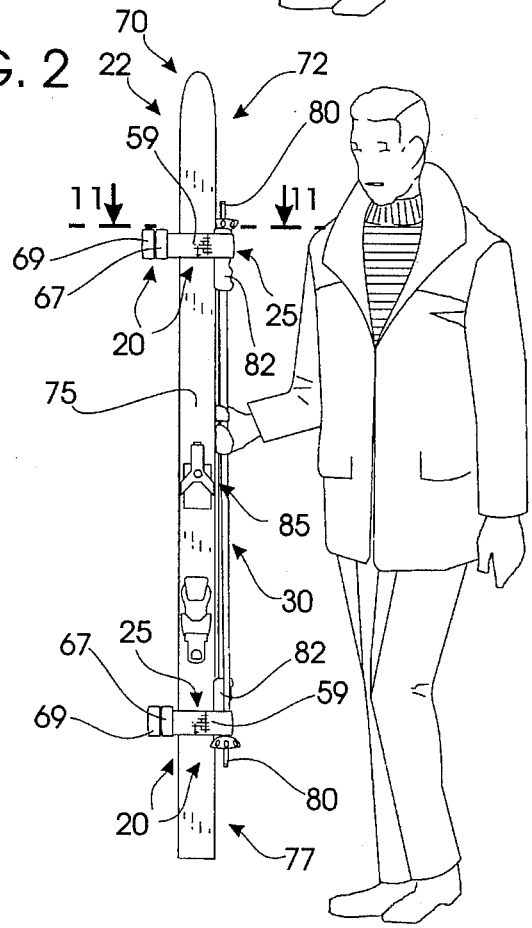
FIG. 2 is an environmental, isometric view of a set of my straps in use, illustrating skis and poles being held at an acute angle.
Figure 3:
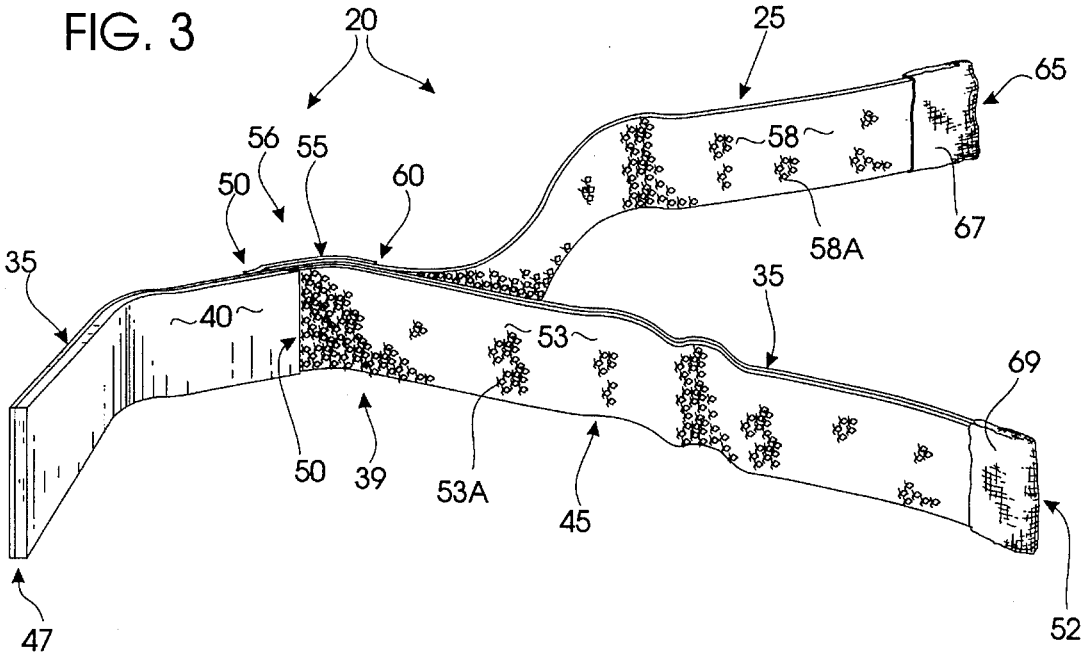
FIG. 3 is an isometric view of the inner side of my strap.
Figure 4:
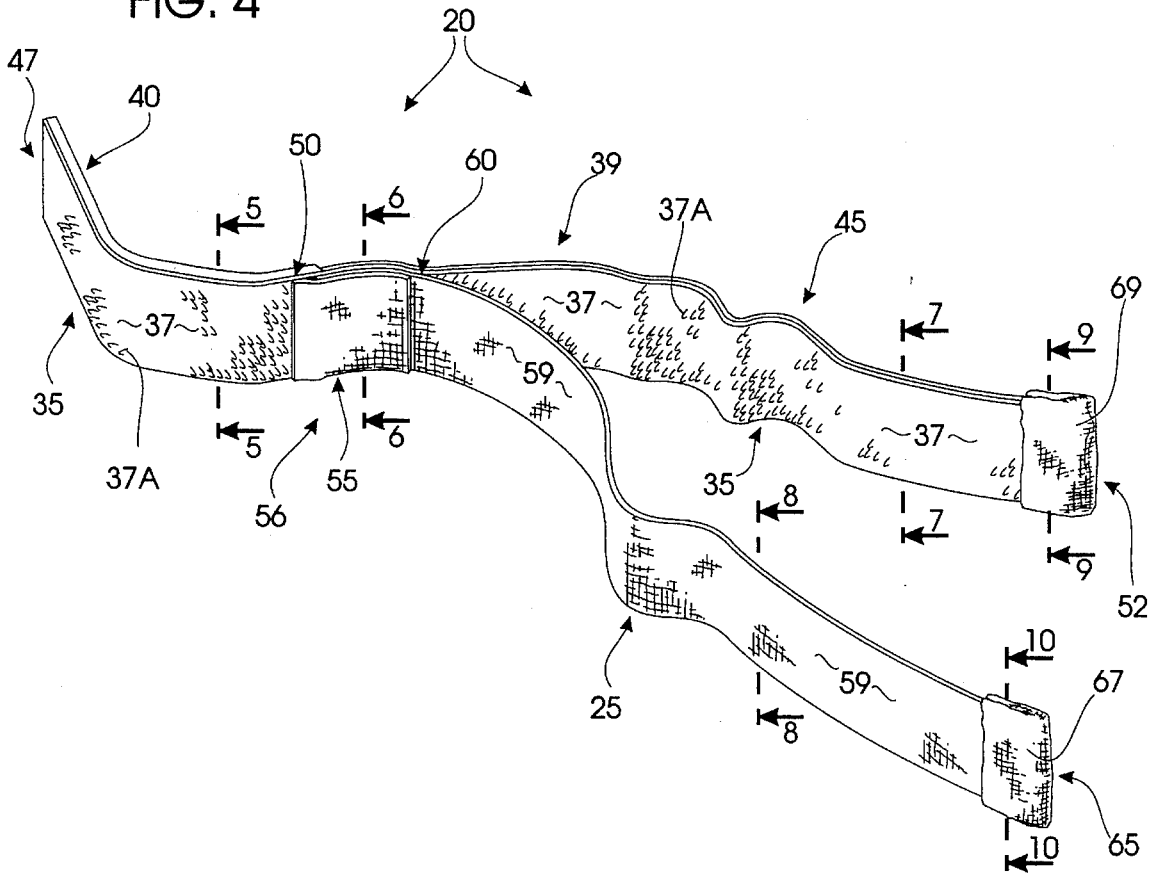
FIG. 4 is an isometric view of the outer side of my strap.
Figure 10:
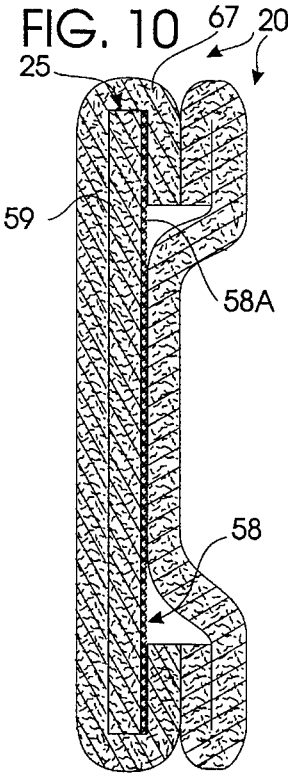
Figure 12:
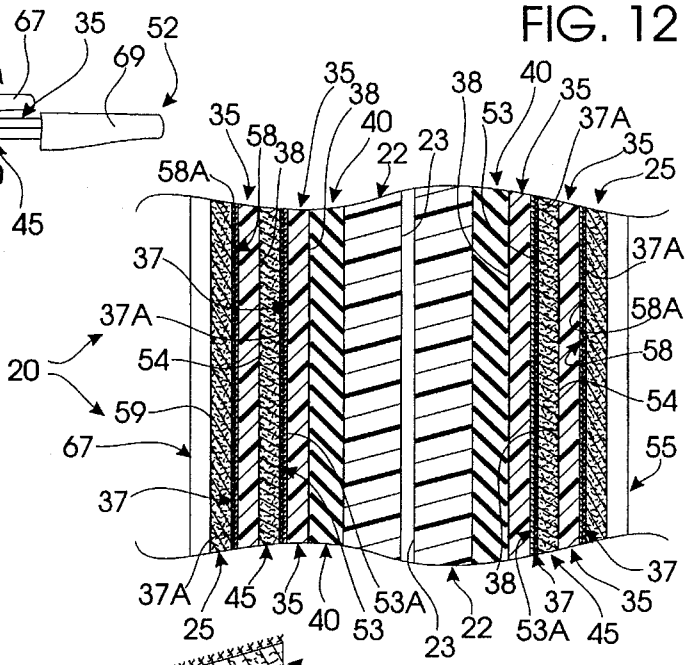
Figure 11:
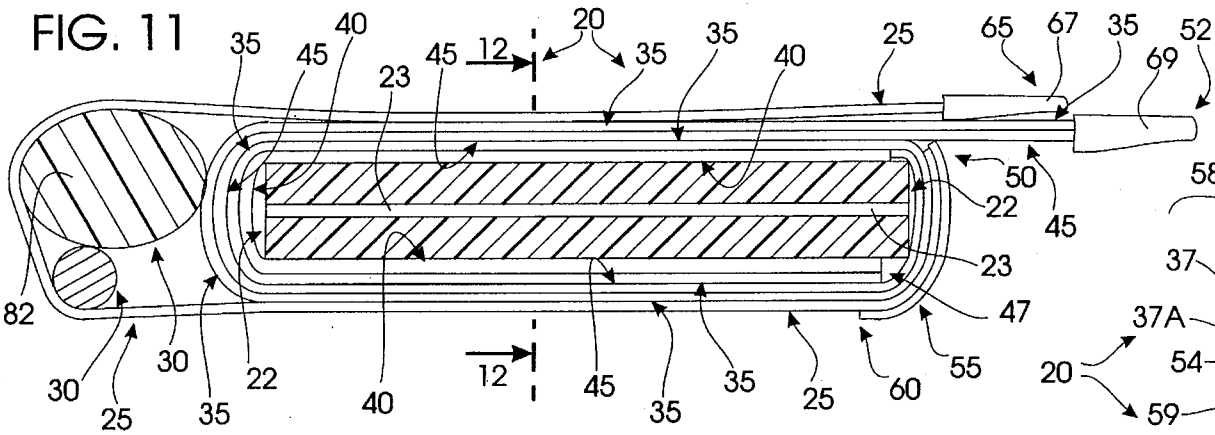
Figure 13:
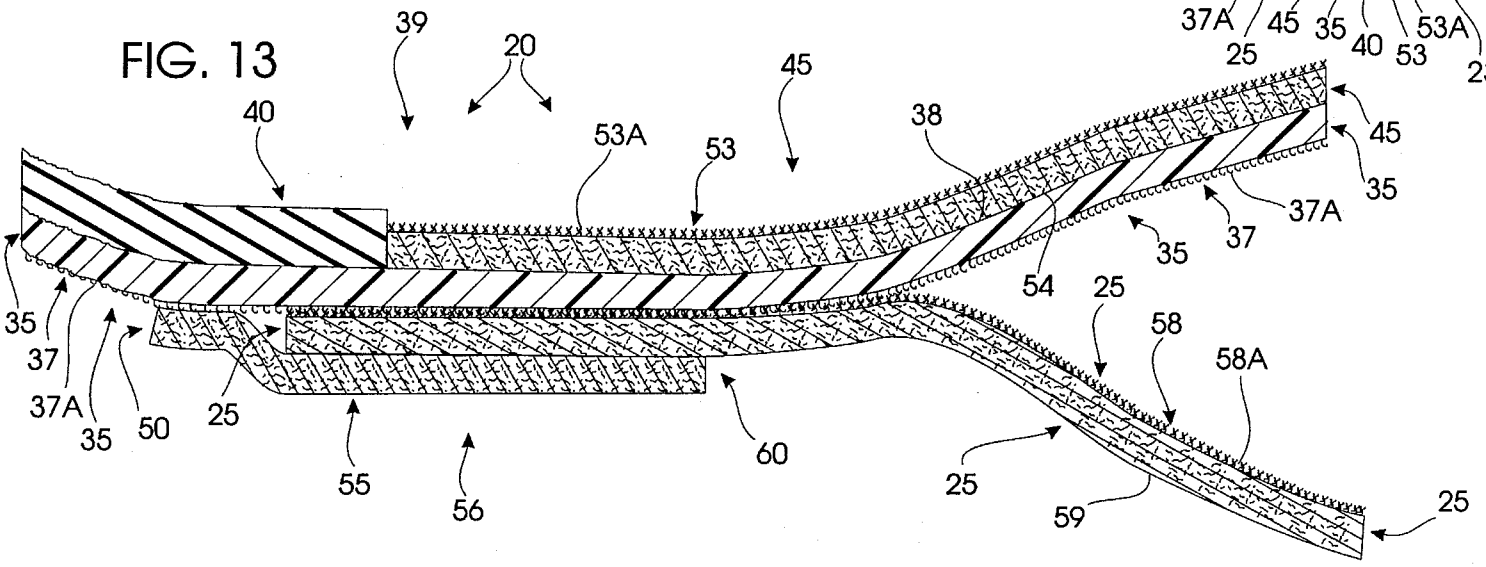
Figure 14:
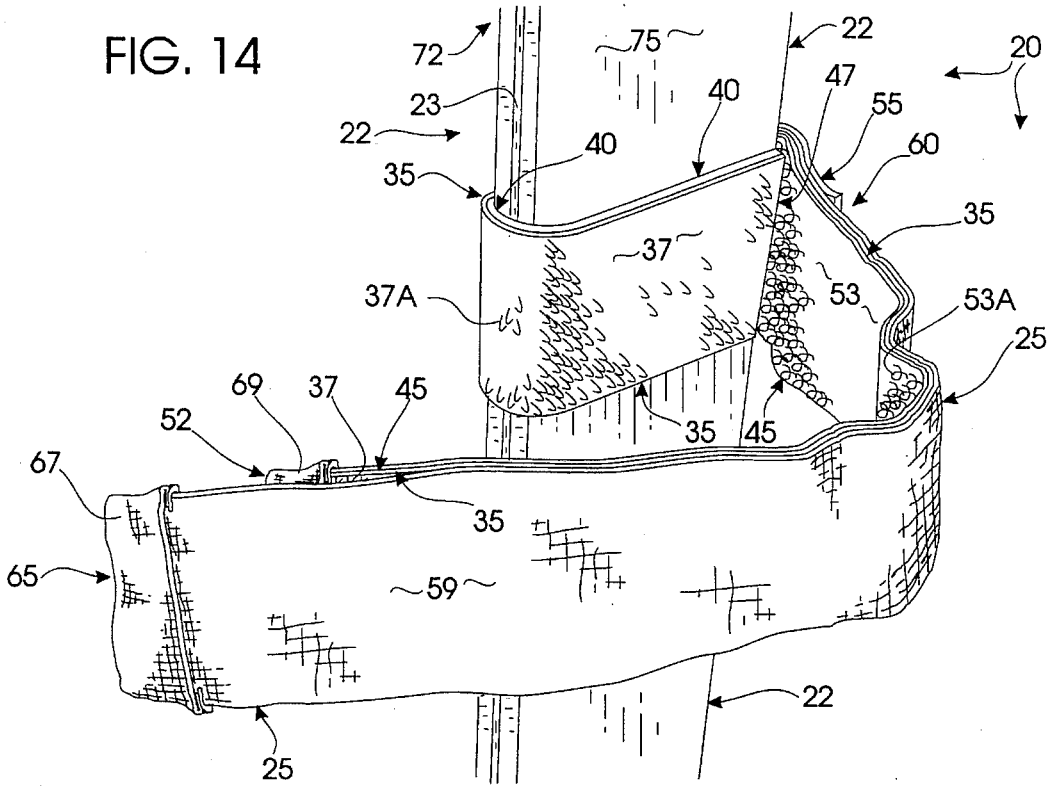
Figure 15:
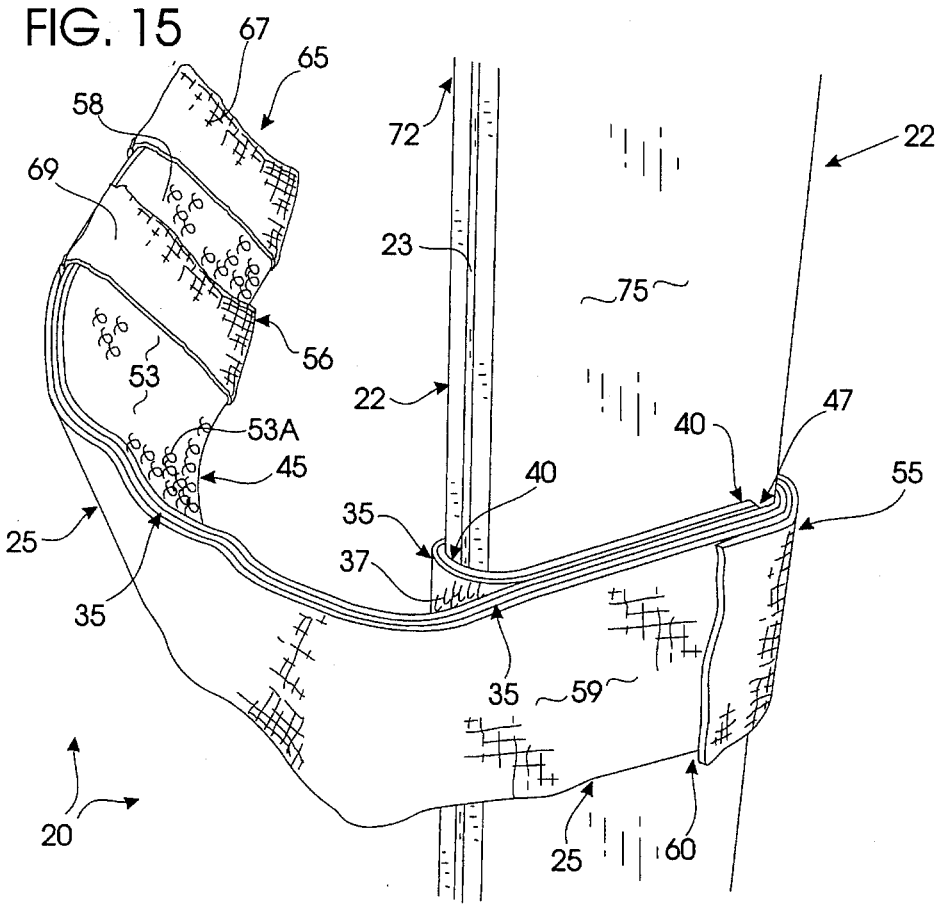
Figure 16:
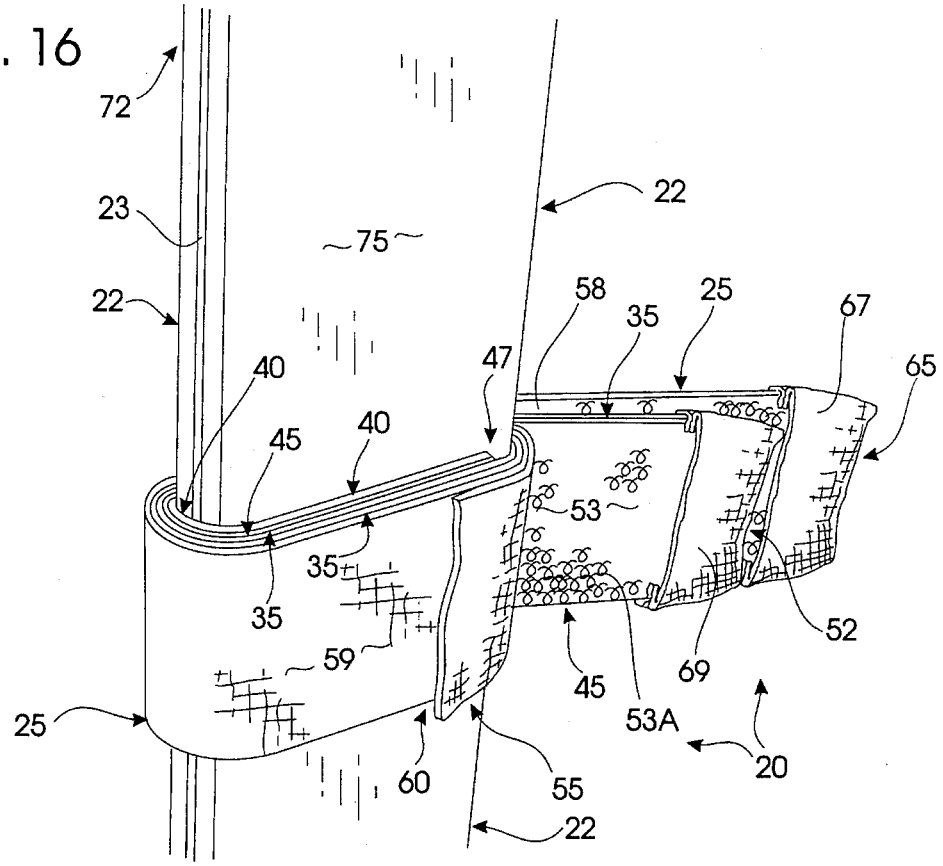
Figure 17:
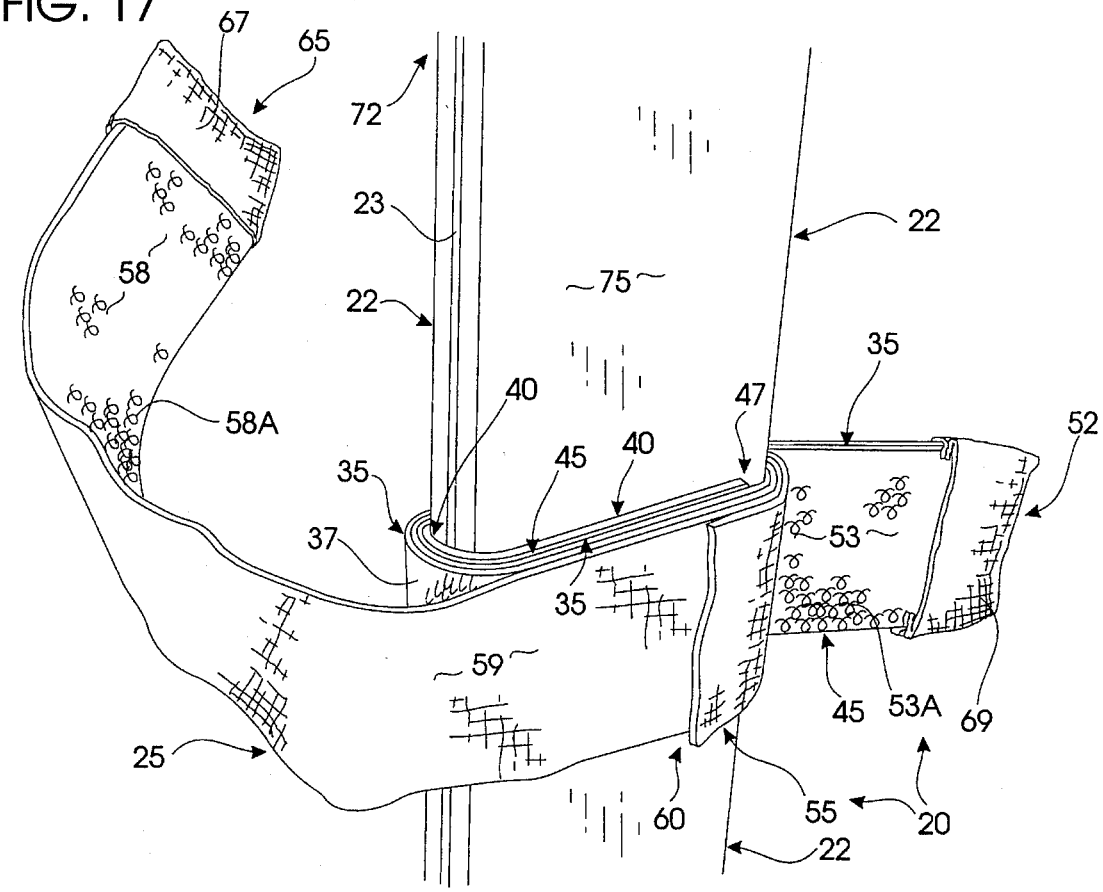
Figure 18:
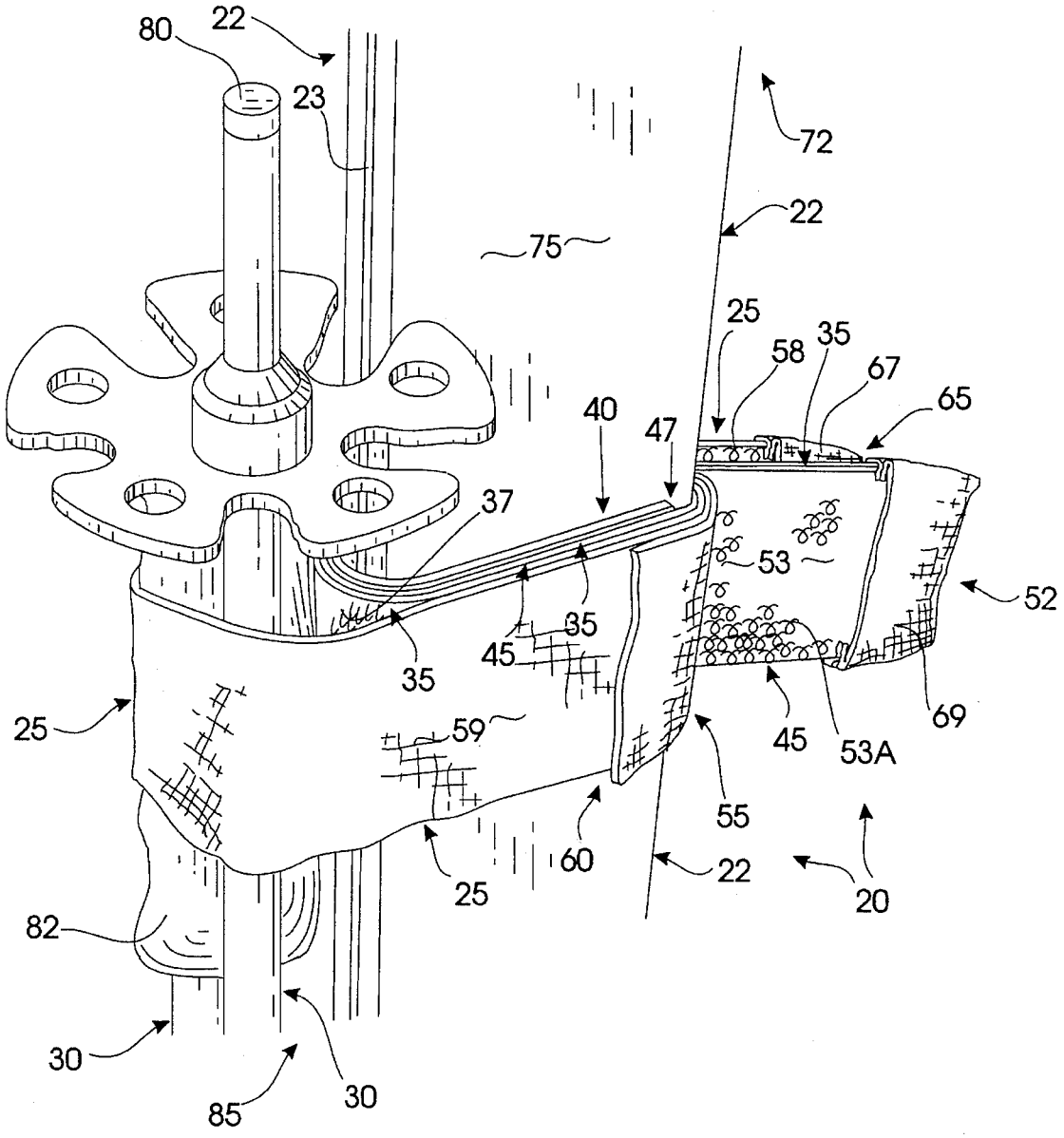

4 with the thickness of the strap and tab exaggerated for illustrative purposes;

FIG. 10 is an enlarged cross sectional view of the ski pole band tab taken generally along line 10—10 of FIG. 4 with the thickness of the band and tab exaggerated for illustrative purposes;

FIG. 11 is an enlarged, fragmentary, cross sectional view of my strap installed on a pair of skis with the ski poles in place taken generally along line 11—11 of FIG. 2;

FIG. 12 is an enlarged, fragmentary, cross sectional view taken generally along line 12—12 of FIG. 11, illustrating the spatial relationship of the strap elements when installed;

FIG. 13 is an enlarged fragmentary view of my strap illustrating the central portion of the strap as illustrated in FIG. 4 with portions omitted for clarity;

FIG. 14 is an environmental, fragmentary, isometric view illustrating initial steps in installing my strap on a pair of skis;

FIG. 15 is an environmental, fragmentary, isometric view illustrating wrapping my strap around a pair of skis, engaging the hook and loop fastener material of the body with the loop fastener backing material;

FIG. 16 is an environmental, fragmentary, isometric view illustrating completed installation of my strap on a pair of skis, without the poles;

FIG. 17 is an environmental, fragmentary, isometric view illustrating separation of a ski pole band from a strap; and, FIG. 18 is an environmental, fragmentary, isometric view illustrating completed installation of my strap on a pair of skis, with the ski poles in place.

DETAILED DESCRIPTION

Figure 1:
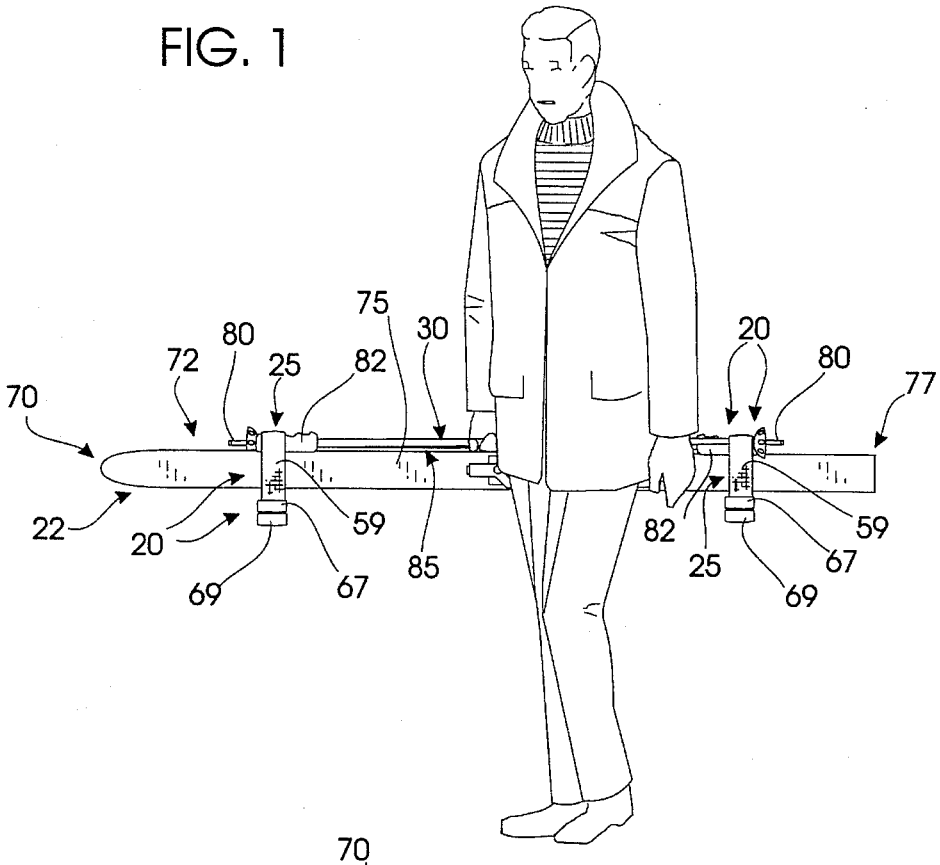
FIG. 1 is an environmental, isometric view of a set of my Ski and Ski Pole Transport Straps in use.

With reference now to the accompanying drawings, the herein disclosed ski and ski pole transport strap is broadly designated by reference numeral 20. Preferably, two identical straps 20 are used together to transport a pair of skis. The straps 20 are wrapped and secured around a pair of skis 22. The skis 22 are disposed with their faces 23 together. Each of the straps 20 has a ski pole band 25 extending from it. The bands 25 allow attachment of a pair of ski poles 30, generally parallel with the skis 22. The ski poles 30 can then be used as a handle to assist in carrying the skis 22 (FIGS. 1 and 2).

Since the straps 20 are identical, only one will be described in detail. The straps 20 are comprised of a central elongated body 35 constructed from hook and loop pile fastener material of the type commonly known as Velcro® or Mastex®. An outer side of the body 35 is comprised of hook fastener material 37 made up of individual pliable hooks 37A. The opposite, inner face 38 of the body 35 is preferably a relatively smooth plastic cloth or the like. The inner face 39 of the strap 20 is affixed to this plastic cloth face. The inner face 39 of the strap 20 is comprised of a gripping surface 40 and a fastener material backing 45.

Figure 5:
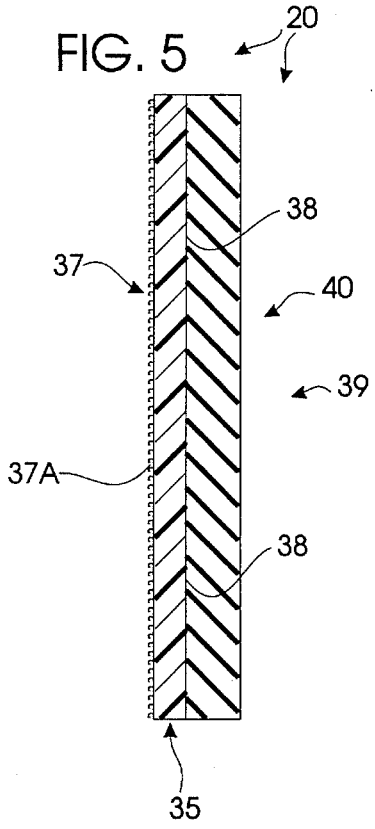
FIG. 5 is an enlarged cross sectional view of my strap, near the inner end, taken generally along line 5—5 of FIG. 4 with the thickness of the strap exaggerated for illustrative purposes.
Figure 6:
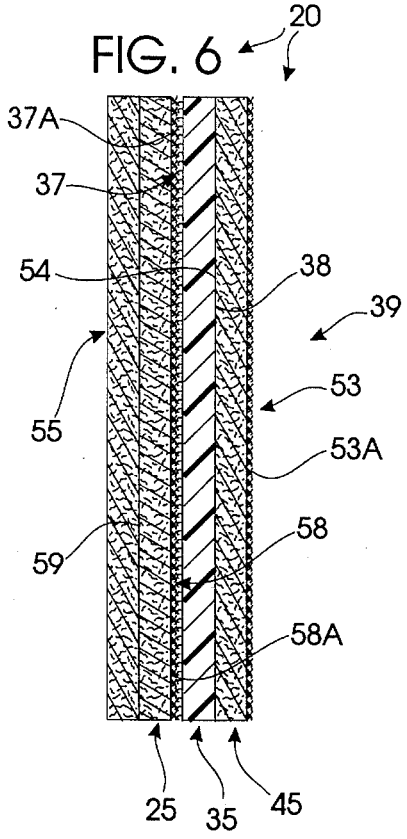
FIG. 6 is an enlarged cross sectional view of the central portion of my strap taken generally along line 6—6 of FIG. 4 with the thickness of the strap exaggerated for illustrative purposes.

The gripping surface 40 extends from an inner end 47 of the body 35 to a first central point 50, approximately one third of the way along the length of the body 35. The material providing the gripping surface 40 is preferably nylon reinforced rubber or the like. The gripping surface material is preferably stitched to the smooth, inner face 38 of the body 35 (FIG. 5). The gripping surface 40 facilitates frictional retention of the skis 22 when the strap 20 is wrapped around them. It is important that the gripping material be of a non-marring or marking nature so as not to damage the finish of the skis 22.

Figure 7:
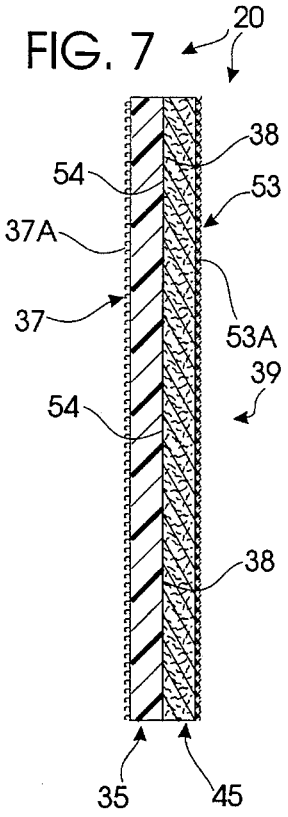
FIG. 7 is an enlarged cross sectional view of the body and fastener material portion of my strap taken generally along line 7—7 of FIG. 4 with the thickness of the strap exaggerated for illustrative purposes.
Figure 8:
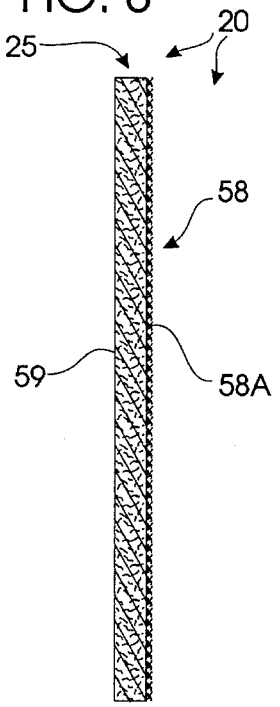
FIG. 8 is an enlarged cross sectional view of the ski pole band taken generally along line 8—8 of FIG. 4 with the thickness of the band exaggerated for illustrative purposes.
Figure 9:
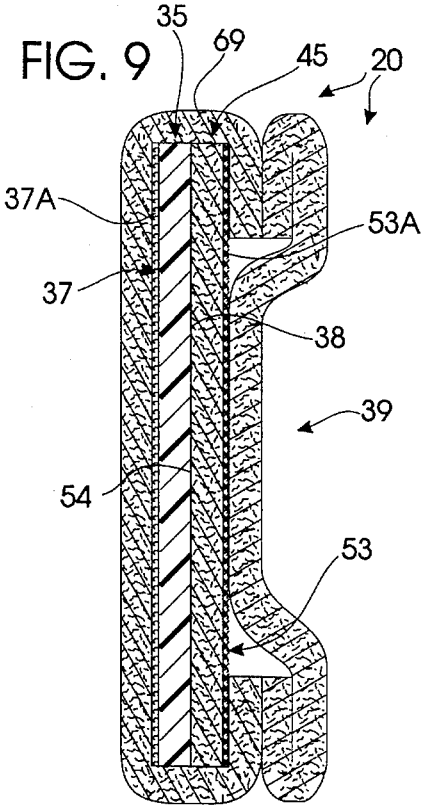
FIG. 9 is an enlarged cross sectional view of the remote end tab of my strap taken generally along line 9—9 of FIG.

The fastener material backing 45 extends from the opposite, remote end 52 of the body 35 to abut the gripping surface 40 at the first central point 50. The loop fastener material 53 comprising the backing 45 faces in the opposite direction of the hook fastener material 37 comprising the body 35. In other words, the smooth sides of the hook fastener material and the loop fastener material 38, 54 face one another (FIG. 7). The fastener material backing 45 provides the loops 53A which the hooks 37A mate with. Preferably, the fastener material backing 45 is stitched to the body 35. The fastener material backing 45 of the strap 20 contacts the hook fastener material 37 comprising the body 35 once the strap 20 is wrapped around a pair of skis 22 (FIG. 12).

A ski pole band 25 extends from a central portion 56 of the body 35. The band 25 extends from the hook fastener face 37 and is preferably secured in place along the body 35 by a reinforcing brake 55. The ski pole band 25 is preferably comprised of a length of loop fastener material 58 which is disposed with its loop face 58A toward the hook fastener material 37 of the body 35. The smooth side 59 of the band 25 faces outwardly. The smooth side 59 acts as a guard to prevent inadvertent engagement of the hook or loop material 37 or 53 of the strap 20 with other cloth, such as clothing, luggage or other skis similarly bound. Thus, the band 25 protects the integrity of the bundled skis or ski and pole assembly. Advertising or identification indicia can be prominently displayed on this smooth surface 59. Alternatively, fashionable colors and designs can be incorporated into the band 25.

The reinforcing brake 55 is a rectangular segment of material, preferably leather or vinyl. It extends from the first central point 50 to a second central point 60 near the center 56 of the body 35 (FIG. 13). In an alternative embodiment, the brake 55 extends from the first central point 50, the full length of the band 25. In this alternative embodiment the brake 55 provides greater reinforcement and a large surface to receive indicia. The reinforcing brake 55 is sewn to the band 25 and the central portion 56 of the body 35. Preferably, the stitching also penetrates the fastener material backing 45 to create a unitary strap 20. The brake 55 also provides a stop during installation of the strap 20.

In the above described preferred embodiment the entire length of one side of the strap 20 is comprised of hook fastener material 37. It is only interrupted near its center by the reinforcing brake 55 attaching the ski pole band 25. The opposite side of the strap 20 is comprised of the gripping surface 40 and the fastener material backing 45. The reinforcing brake 55 is positioned opposite the fastener material backing 45 at its abutment to the gripping surface 40. When the band 25 is not retaining poles 30, it lies along approximately one half of the length of the body 35, loosely engaging the hook fastener material 37.

As will be apparent to those skilled in the art, the placement of hook and loop material 37, 53 can be reversed. In other words, the body 35 could be comprised of loop fastener material 53 while the fastener material backing 45 could be comprised of hook fastener material 37. In that instance, the ski pole band 25 would comprise a strip of hook fastener material 37 to mate with the body's loop fastener material 53.

Preferably, the bitter end 65 of the band 25 is reinforced by a gripping tab 67 stitched to it. The remote end 52 of the body 35, is also reinforced by a gripping tab 69. These tabs 67, 69 facilitate handling the strap 20 during installation and removal. They provide a surface for a user to grip, insuring the strap 20 and band 25 are installed tightly. The tabs 67, 69 also prevent the band 25 and strap 20 from slipping from one's fingers during removal.

Operation

In operation, a pair of the above described straps 20 are wrapped around a pair of skis 22 to hold them together. The skis 22 are placed face 23 to face 23. The tips 70 of the skis may be together or oppositely oriented. The first strap 20 is deployed around the skis 22 relatively near an end 72 of the skis 22. The gripping surface 40 is lain against the top 75 of one of the skis 22 (FIG. 14). The strap 20 is wrapped around the skis 22 (FIG. 15). The body tab 69 is gripped, and the strap 20 is pulled tight (FIG. 16). The fastener material backing 45 of the strap 20 engages the outwardly facing hook fastener material 37 of the body 35, opposite the gripping surface 40. When the strap 20 is in place, the hooks 37A and loops 53A fully engage. The reinforcing brake 55 halts installation of the strap 20 with the tabs 67, 69 in a convenient position for use, in the manner explained below. A second strap 20 is similarly wrapped around the skis 22 near the opposite end of the skis 77 and tightened.

With the skis 22 bound together, the poles 30 are attached, if desired. The band and body tabs 67, 69 of each strap 20 are gripped. Each pole band 25 is pulled clear of the hook fastener material 37 of its associated body 35 (FIG. 17). The ski poles 30 are placed generally parallel to the skis 22, preferably with the tip 80 of one pole 30 adjacent to the grip 82 of the other. The ski pole bands 25 are lain over the ski poles 30 (FIG. 18). In turn, each band tab 67 is gripped and the band 25 pulled tight. The loop fastener material 58 comprising the bands 25 engages the hook fastener material 37 of the strap 20. The preferred arrangement of the ski poles 30 with one tip 80 adjacent to the other grip 82 offsets the poles 30 slightly from the skis 22. This offset 85 facilitates using the poles 30 as a handle to carry the ski and ski pole assembly. Due to the frictional gripping action of the gripping surface 40 of the strap 20 and the placement of the poles 22, the ski and pole assembly can be carried at any angle as illustrated in FIG. 1 and 2.

The tabs 67, 69 may be used to unbundle the skis 22 and the poles 30. The band and body tabs 67, 69 of each strap 20 are gripped. While the body tab 69 is held in place, the pole band 25 is pulled clear. The ski poles 30 are then set aside. The body tab 69 is then grasped and pulled. This pulls the fastener backing 45 clear of the body 35, releasing the skis 22. The straps 20 may be rolled up and placed in a pocket, backpack or the like. More conveniently, the straps 20 may be wrapped around an arm or leg of a user or similarly stowed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A strap for bundling and orienting a set of skis and poles for convenient carrying, said strap comprising:

an elongated body comprising an inner side, an opposite outer side provided with fastener material, an inner end, and a remote end;

a gripping surface affixed to said inner side of said body proximate said inner end, for frictionally enveloping a pair of skis to be bound by said strap;

a fastener material backing disposed on said body inner side and extending from said gripping surface to said remote end for releasably engaging said body outer side fastener material when said strap is wrapped around said skis; and, a ski pole band for separately, releasably binding ski poles to the previously bound skis, said ski pole band extending from a central portion of said body and comprising an inner side provided with fastener material adapted to selectively mate with said body outer side fastener material, and a smooth, protective outer side for normally guarding the resulting outer circumference of the installed strap.

2. The strap as defined in claim 1 wherein:

said remote end of said body comprises a reinforced gripping tab;

said ski pole band terminates in an end comprising a reinforced gripping tab that cooperates with said body gripping tab;

said body gripping tab and said pole band gripping tab are disposed adjacent one another when said strap initially envelops said skis so the pole band may be thereafter readily disassociated from said strap to thereafter encircle the poles without loosening the skis.

3. The strap as defined in claim 1 further comprising a reinforcing brake disposed at the central portion of said body for securing said ski pole band to said body and for terminating engagement of fastener material when the strap is installed.

4. The strap as defined in claim 3 wherein:

said remote end of said body comprises a reinforced gripping tab; and, said ski pole band terminates in an end comprising a reinforced gripping tab that cooperates with said body gripping tab.

5. The strap as defined in claim 4 wherein said ski pole band is secured to said first ply by a portion of said band stitched between said first ply and said reinforcing brake maintaining alignment of said band with said body.

6. The strap as defined in claim 5 wherein said portion of said band and said central portion of said body are stitched between said reinforcing brake and an end portion of said fastener material backing.

7. A strap system for temporarily binding skis and poles together for easy carrying and stowage, said system comprising:

strap means for securing the skis in face to face relation, each of said strap means comprising:

an elongated body comprising an inner side, an opposite outer side provided with fastener material, an inner end, and a remote end;

a gripping surface affixed to said inner side of said body proximate said inner end for frictionally enveloping a pair of skis to be bound by said strap means;

a fastener material backing disposed on said body inner side and extending from said gripping surface to said remote end for releasably engaging said body outer side fastener material when said strap means is wrapped around said skis;

a ski pole band for separately, releasably binding ski poles to the previously bound skis with the poles generally parallel with the skis, said ski pole band extending from a central portion of said body and comprising an inner side provided with fastener material adapted to selectively mate with said body outer side fastener material, and a smooth, protective outer side for normally guarding the resulting outer circumference of the installed strap means;

whereby grips and tip guards of said poles are disposed in close contact with said skis, facilitating hand carrying of the bound skis and poles by manually gripping said poles.

8. The system as defined in claim 7 wherein:

said remote end of said body comprises a reinforced gripping tab;

said ski pole band terminates in an end comprising a reinforced gripping tab that cooperates with said body gripping tab;

said body gripping tab and said pole band gripping tab are disposed adjacent one another when said strap means initially envelops said skis so the pole band may be thereafter readily disassociated from said strap means to thereafter encircle the poles without loosening the skis.

9. The system as defined in claim 7 wherein said strap means comprises a reinforcing brake disposed at the central portion of said body for securing said ski pole band to said body and for terminating engagement of fastener material when said strap means is installed.

10. The system as defined in claim 9 wherein:

said remote end of said body comprises a reinforced gripping tab; and, said ski pole band terminates in an end comprising a reinforced gripping tab that cooperates with said body gripping tab.

11. The system as defined in claim 10 wherein said ski pole band is secured to said first ply by a portion of said band stitched between said first ply and said reinforcing brake maintaining alignment of said band with said body.

12. The system as defined in claim 11 wherein said portion of said band and said central portion of said body are stitched between said reinforcing brake and an end portion of said fastener material backing.

13. A process for bundling a pair of skis together and releasably attaching ski poles to skis so, said process comprising the steps of:

a) placing a pair of skis face to face;

b) deploying a pair of spaced apart straps around said skis, each of said straps comprising:

an elongated body comprising an inner side, an opposite outer side provided with fastener material, an inner end, and a remote end;

a gripping surface affixed to said inner side of said body proximate said inner end;

a fastener material backing disposed on said body inner side and extending from said gripping surface to said remote end;

a ski pole band extending from a central portion of said body and comprising an inner side provided with fastener material adapted to selectively mate with said body outer side fastener material;

c) positioning said gripping surface of a first strap against a top of one of said skis relatively near one end of the skis;

d) wrapping said body of the first strap around said skis, maintaining said gripping surface in contact with said ski top;

e) engaging said outer side fastener material of said body of the first strap with the inner fastener material of the first strap to bind said skis together;

f) positioning said gripping surface of a second strap against a top of one of said skis relatively near an opposite end of the skis;

g) wrapping said body of the second strap around said skis, maintaining said gripping surface in contact with said ski top;

h) engaging said outer side fastener material of said body of the first strap with the inner fastener material of the first strap to bind said skis together;

i) placing a pair of ski poles generally parallel to and against said skis bound by said straps;

j) releasably binding said ski poles to said skis by wrapping each of said ski pole bands over said ski poles and engaging said hook fastener material with said ski pole bands.

14. The process as defined in claim 13 wherein the ski poles of step i) are placed with a tip of one adjacent a grip of the other.

15. The process as defined in claim 14 wherein said skis are placed with their tips adjacent one another.

16. The process as defined in claim 14 wherein said skis are placed with their tips opposite one another.

* * * * *